United States Patent [19]

Ljung

[11] 4,319,463

[45] Mar. 16, 1982

[54] REFRIGERATED DISPLAY CHEST

[75] Inventor: Hans G. Ljung, Bjärred, Sweden

[73] Assignee: Aktiebolaget Electrolux, Stockholm, Sweden

[21] Appl. No.: 84,877

[22] Filed: Oct. 15, 1979

[30] Foreign Application Priority Data

Oct. 20, 1978 [SE] Sweden ..... 7810952

[51] Int. Cl.[3] ..... A47F 3/04

[52] U.S. Cl. ..... 62/256

[58] Field of Search ..... 62/256

[56] References Cited

U.S. PATENT DOCUMENTS 3,226,945 1/1966 Spencer ..... 62/256

3,850,003 11/1974 Beckwith et al. ..... 62/256 X 3,937,033 2/1976 Beckwith et al. ..... 62/256 X 4,117,698 10/1978 Vogel ..... 62/256

4,120,174 10/1978 Johnston ..... 62/256

4,197,718 4/1980 Abraham et al. ..... 62/256 X

*Primary Examiner*—Lloyd L. King

*Attorney, Agent, or Firm*—Alfred E. Miller

[57] ABSTRACT

A refrigerated display chest with an open top has an air circulation channel to enable flow of air in one direction for a cooling cycle, and reverse flow for a defrosting cycle. A diversion channel is provided at the front of the chest, to direct exhaust air away from the chest, during defrosting cycles, so as to avoid interference with external air drawn into the chest at this time.

9 Claims, 3 Drawing Figures

REFRIGERATED DISPLAY CHEST

This invention relates to an improvement in a display chest for cooled or frozen goods, wherein an air channel is provided for circulating air around the stored goods and over the goods at the open top of the chest, and with fans and cooling elements in the channel. The chest has means for reversing the direction of the air flow and means for forcing a larger quantity of air per unit of time through the channel during defrosting than during cooling.

Display chests of this type have been proposed earlier and such chests are also on the market. They are an improvement, compared to previous chests having electric heating elements for defrosting and control means for these elements, partly because the cost for the assembly is small and partly because power is saved since electric heat is not needed for melting frost on the cooling elements. In certain cases, however, further improvements are desired. One example occurs when a display chest stands against a wall and has a shelf top part or a closet on the wall above the chest. In the opening of the channel from which the air flow leaves the circulation path during defrosting, guide members are provided which cause the air to be blown out in a direction forming an acute angle to the horizontal plane in which the air passes the open top of the chest during cooling. As a result, the air will come above the top of the chest.

If there is open space above the chest, the arrangement operates in the desired manner. Thus, during defrosting a mixture of ambient warm air and a remainder of blown out cold air is sucked into the channel. However, if there are shelves or closets or other obstacles in the air path above the chest, for example on a wall against which the rear long-side of the chest is positioned, the ambient warm air is more or less prevented from being mixed with the suction air, which is generally air blown out from the channel. This results on one hand in increased defrosting time and, on the other hand, in undesired low temperatures of the goods stored on the shelf. Long defrosting time also results in increased temperature of the goods in the chest, and this is very unsatisfactory.

According to the invention these drawbacks can be avoided by providing a diversion channel along one side of the chest, at a given distance above the opening of the circulation channel for exhaust air on defrosting. In this diversion channel the air blow out is directed away from the chest and is diverted to a direction deviating less than 90° from the direction in the horizontal plane in the open top of the chest in which air flows over the goods during cooling.

In order that the invention will be more clearly understood, it will now be disclosed in greater detail with reference to the accompanying drawings, wherein.

Figure 1:
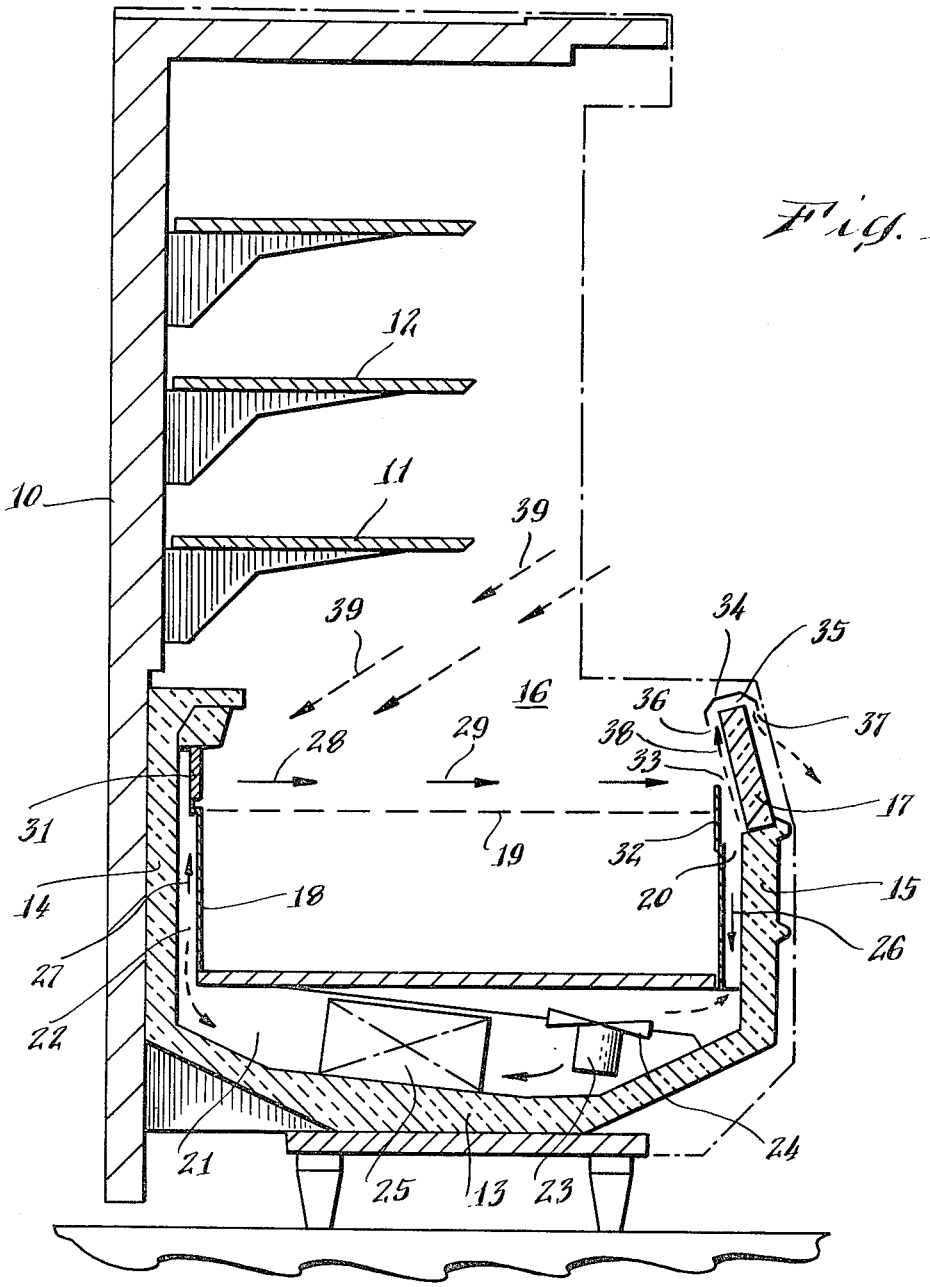
FIG. 1 is cross-sectional view, in a vertical transverse plane, of a cooling or freezing chest in accordance with the invention, placed against a wall having shelves.

In the drawings, the air flow through the cooler during normal cooling of the chest is shown by the solid arrows, and the air flow during defrosting cycles is shown by dashed arrows.

Figure 2:
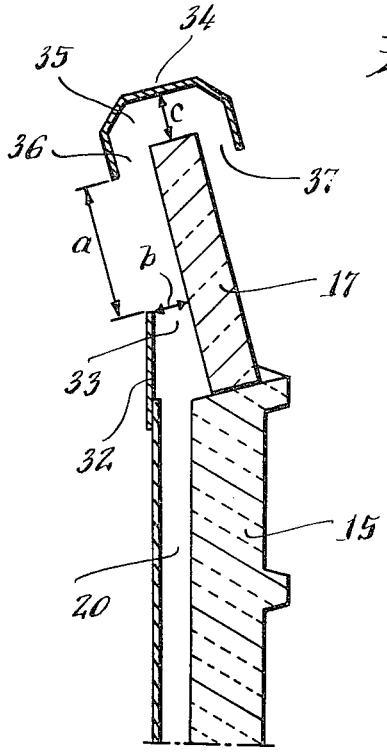
FIG. 2 is an enlarged detail of the top of the front wall of the chest of FIG. 1.

FIGS. 1 and 2 show a single-deck open top freezer display chest placed against a wall 10, with shelves 11, 12 on the wall above the chest. The chest has a heat-insulated bottom 13 with a drain, not shown, for water formed during defrosting. The chest has a heat-insulated rear long-side wall 14, an insulated front long-side wall 15 and two insulated transverse end walls 16 (only one of which appears in the drawings). The insulated front wall is lower than the other walls but has a glass wall 17 in its upper part. The glass wall is inclined toward the interior of the chest. The chest contains a sheet-metal box 18 for storing of goods up to a level not higher than a plane 19 below the top of the chest. The box 18 is also provided with at least one vertical wall which terminates at a height substantially below the height of the top of glass wall 17. An air channel 20 is formed at the front between the sheet-metal box 18 and the heat-insulated walls, a channel 21 is formed under the box and a channel 22 is formed behind the box. Circulation in the chest around the box 18 with the goods stored therein is effected by reversing fans 24 disposed in the lower channel 21, the fans being driven by motors 23, and the air is cooled by elements 25. During cooling, the circulation air is sucked downwards in the front channel 20 as shown by the arrow 26, through the lower channel 21 and upwards in the rear channel 22 as shown by the arrow 27. Then the cold air flows as indicted by the arrows 28, 29, 30 horizontally over the goods in the chest and the cold mass of air lying above the stored goods. The chest has guides 31 over the rear channel 22 to guide the cold air in a direction horizontally over the goods, whereas no special guides are provided at the suction opening 33. An inner glass window 32 is provided at this suction opening, the suction opening 33 being formed between the window 32 and the glass wall 17 through which air is sucked into the front channel 20.

During operation frost is formed on the cooling elements 25 and this frost has to be removed so that operation of the chest is maintained. Defrosting is suitably done at night or at least at times when the premises, in which the chest is placed, are not open. When defrosting is to take place, the cooling elements 25 are switched off and the motors 23 operating the fans 24 are driven in the direction opposite the normal direction, by conventional control means (not shown). At the same time the operational conditions (e.g. air speed) are changed so that the fans 24 will supply a larger quantity of air per unit of time than during cooling, preferably double this quantity or more. The chest has an edging 34 above the glass wall 17 defining air channel 35 between the glass wall and the edging. The latter has an inlet opening 36 at a distance a above the opening 33 to the front channel 20 and forms an arc in cross section so that there is an exhaust opening 37 at the outside of the chest. The distance a should be at least double the width b of the suction opening 33, and the width c (thickness) of the diversion channel 35 should at least equal the width b (thickness) of the opening 33.

During defrosting air is forced upwards by the fans 24 through the channel 20 and out through the opening 33. Due to its comparatively great velocity the air continues upwards as shown by the dashed arrow 38 and enters into the opening 36 of the diversion channel 35, in which the air flow is diverted to flow in a direction deviating more than 90° from the direction in a horizontal plane across the goods in the chest in which the cold air flows during normal cooling. During defrosting air is blown out through the exhaust opening 37 in a direction away from the chest and downwards. The result is that air is drawn in at the opening to the rear channel 22, as shown by the dashed arrows 39. This means that warm air in the premises is taken into the circulation path for heating the cooling elements 25 and melting frost thereon.

The air over the goods nearest the chest opening 33 is cold and heavy and thus is not to any significant extent entrained by the flowing air. When, during normal cooling, the air flows in the opposite direction, the conditions around the opening 33 have the effect that substantially only cooled air is circulated without any substantial amount of ambient warm air being added thereto. The cold layer of air moving as indicated by the arrows 28, 29, 30 is cold and heavy air flows towards the opening 33 at a velocity which is lower than the velocity during defrosting. Thus, there is no significant suction of ambient air at this opening and the diversion channel 35 fulfills its function without special guides or flaps. It is sufficient to insure that the distance a between the openings 33 and 36 is appropriate.

The invention is of advantage not only for the special use of the chest together with shelves disposed above it. For the layout of premises with a refrigerated chest in accordance with the invention, it does not matter what is above the chest, as long as the opening to the chest is accessible for customers. Operation of the chest is safe under all conditions. Further, a considerably reduced defrosting time is achieved. This is an advantage because the increase of temperature of the goods stored in the chest can be minimized during defrosting.

Figure 3:
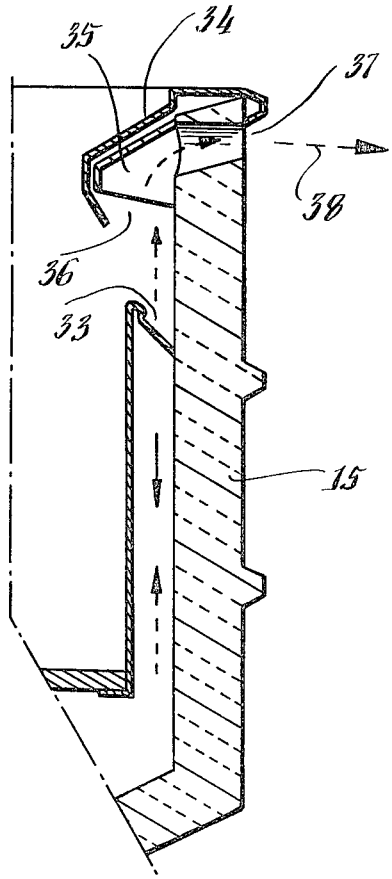
FIG. 3 is an enlarged view of a modification of the top of the front wall of the chest of FIG. 1.

The invention is not limited to the design of a freezer display chest as illustrated in FIGS. 1 and 2 and described in the specification, but can be modified in many ways within the scope of the following claims. As an example, FIG. 3 is referred to, which shows the upper edge of a chest without the glass window. In the arrangement of FIG. 3, the various channels have the same relative dimensions as in the arrangement of FIGS. 1 and 2, but the edge 34 in this case does not form the upper boundary of the deviation channel. The edge 34 is formed to inhibit exhaust air from the opening 33 from movement into the chest, as shown, but the deviation channel itself is directed to flow generally horizontally outward from the chest, as illustrated. Further sheet metal guides may be provided, as illustrated, to form the interior of the deviation channel.

A freezer display chest has been described above but the conditions are analogous in a cooler chest, and the invention must be considered to be applicable to all chests having circulation of cooled air and defrosting of the type as described.

What is claimed is:

1. In an open top display chest for cold or frozen goods, said chest being provided with insulated walls, one of said walls having a transparent portion, an open top container having vertical side walls within said walls, a space between said walls and said container being an air circulation channel for circulating air around the goods as well as across the goods at the open top thereof, an exhaust opening between the top of said vertical wall and the top of said transparent portion of the adjacent insulated wall, cooling element means in said channel, fan means reversing the direction of air flow in said channel, and said fan means directing a larger quantity of air per unit time during defrosting than during cooling; the improvement comprising an edging positioned above one of said insulated walls to form a diversion channel spaced above the top of said adjacent wall, one of said vertical side walls of said container terminating at its upper end a certain distance below said edging, said diversion channel being positioned to direct exhaust air away from said cabinet in a direction more than 90° from the horizontal surface on which air is flowing across the top of the goods in a cooling mode.

2. The display chest of claim 1 wherein said diversion channel constitutes edging extending inwardly above the top of said adjacent insulated wall to define an inlet opening for said diversion channel above said exhaust opening, the output of said diversion channel being on the exterior of said chest.

3. The display chest of claim 2 wherein the distance A between said exhaust opening and the inlet opening to said diversion channel is greater than the thickness of the exhaust opening of said air circulation channel.

4. The display chest of claim 3 wherein said distance is more than twice the thickness of said exhaust opening of said air circulation channel.

5. The display chest of claim 3 wherein the thickness of the inlet opening of the diversion channel and the thickness of the diversion channel are at least equal to the thickness of the exhaust opening of the air circulation channel.

6. The display chest of claim 1 wherein said exhaust opening is throttled with respect to said air circulation channel.

7. The display chest of claim 1 wherein said fan means is inserted in said air circulation channel to draw air into said exhaust opening during a cooling mode whereby air is drawn forwardly across the top of said goods in a horizontal direction in said cooling mode, said diversion channel being positioned to divert air flowing upwardly from said exhaust opening to flow downwardly and forwardly of the front of said chest during a defrosting mode.

8. The display chest of claim 1 wherein air is directed to flow forwardly in a horizontal plane over said goods in a cooling mode, and said diversion channel is positioned to direct air to flow generally horizontally outwardly from said front wall of said chest during a defrosting cycle.

9. In an open top display chest for cold or frozen goods, said chest being provided with insulated walls, an open top container within said walls having vertical side walls but spaced therefrom to form an air circulation channel for circulating air around the goods as well as across the goods at the open top thereof, an exhaust opening between the top of said vertical wall and the top of said adjacent insulated wall, cooling element means in said channel, fan means reversing the direction of air flow in said channel, and said fan means directing a larger quantity of air per unit time during defrosting than during cooling; the improvement comprising an edging positioned above one of said insulated walls to form a diversion channel spaced above the top of said adjacent insulated wall, one of said vertical side walls of said container terminating at its upper end a certain distance below said edging, said diversion channel receiving air from said exhaust opening during a defrost mode, and said diversion channel having an outlet exterior of said display chest and constructed and arranged to exhaust air in a direction to avoid direct mixing with ambient air drawn into the open top of said display chest during a defrosting mode.

* * * * *